US007831363B2

(12) United States Patent
Quigley

(10) Patent No.: US 7,831,363 B2
(45) Date of Patent: Nov. 9, 2010

(54) WIRELESS CONTROL SYSTEM FOR A LOAD HANDLING VEHICLE

(75) Inventor: Thomas P. Quigley, Oshkosh, WI (US)

(73) Assignee: Oshkosh Corporation, Oshkosh, WI (US)

( * ) Notice: Subject to any disclaimer, the term of this patent is extended or adjusted under 35 U.S.C. 154(b) by 1076 days.

(21) Appl. No.: 11/478,438

(22) Filed: Jun. 29, 2006

(65) Prior Publication Data

US 2008/0004777 A1 Jan. 3, 2008

(51) Int. Cl.
*G06G 7/00* (2006.01)
*G06G 7/76* (2006.01)

(52) U.S. Cl. ..... 701/50; 701/36; 701/53; 342/357.09; 37/347; 37/379; 340/673

(58) Field of Classification Search ..... 701/50, 701/53, 56; 702/188; 180/271; 294/68.1, 294/68.2, 68.22; 100/210, 229 A; 361/1, 361/41–42, 606; 280/763.1; 298/7; 414/547, 414/540; 342/357.09; 37/347, 379; 340/673
See application file for complete search history.

(56) References Cited

U.S. PATENT DOCUMENTS

| | | | | |
|---|---|---|---|---|
| 3,640,411 | A * | 2/1972 | Anderson | 414/304 |
| 3,786,949 | A * | 1/1974 | Sutton | 414/406 |
| 3,858,927 | A * | 1/1975 | Sutton | 294/68.26 |
| 3,965,733 | A | 6/1976 | Hutchings et al. | |
| 4,216,868 | A | 8/1980 | Geppert | |
| 4,222,491 | A | 9/1980 | Geppert | |
| 5,659,470 | A * | 8/1997 | Goska et al. | 701/35 |
| 6,836,982 | B1 * | 1/2005 | Augustine | 37/348 |
| 6,885,930 | B2 * | 4/2005 | Wang | 701/70 |
| 6,947,819 | B2 * | 9/2005 | Nelson et al. | 701/50 |
| 6,980,959 | B1 * | 12/2005 | Garrow et al. | 705/7 |
| 7,089,099 | B2 * | 8/2006 | Shostak et al. | 701/32 |
| 7,103,460 | B1 * | 9/2006 | Breed | 701/29 |
| 7,181,370 | B2 * | 2/2007 | Furem et al. | 702/188 |
| 7,319,848 | B2 * | 1/2008 | Obradovich et al. | 455/99 |
| 7,343,232 | B2 * | 3/2008 | Duggan et al. | 701/24 |
| 7,379,800 | B2 * | 5/2008 | Breed | 701/29 |

(Continued)

FOREIGN PATENT DOCUMENTS

AU 2002306588 A1 * 9/2002

(Continued)

OTHER PUBLICATIONS

"A Robotic Excavator for Autonomous Truck Loading", Anthony Stentz et al., The Robotics Institute; 0-7803-4465-0/98 IEEE, pp. 1885-1893. cited by other.*

(Continued)

*Primary Examiner*—Cuong H Nguyen
(74) *Attorney, Agent, or Firm*—Foley & Lardner LLP

(57) ABSTRACT

Another embodiment of the invention relates to a vehicle. The vehicle includes a chassis supported by a plurality of wheels; an electronically controlled load handler supported by the chassis; a first transceiver located on the vehicle and configured to receive control signals configured to control the load handler; and a second transceiver located on the vehicle and coupled to the load handler. The first and second transceivers are configured transmit signals there between wirelessly and the second is further configured to transmit signals representative of the control signals to the load handler.

19 Claims, 6 Drawing Sheets

U.S. PATENT DOCUMENTS

| | | | | |
|---|---|---|---|---|
| 7,386,716 | B2 * | 6/2008 | Fredriksson | 713/151 |
| 7,406,399 | B2 * | 7/2008 | Furem et al. | 702/182 |
| 7,555,369 | B2 * | 6/2009 | Pillar et al. | 701/1 |
| 7,574,821 | B2 * | 8/2009 | Furem | 37/348 |
| 7,578,079 | B2 * | 8/2009 | Furem | 37/348 |
| 7,630,802 | B2 * | 12/2009 | Breed | 701/29 |
| 2003/0176958 | A1 * | 9/2003 | Hagenbuch | 701/29 |
| 2005/0085973 | A1 * | 4/2005 | Furem et al. | 701/50 |
| 2006/0030990 | A1 * | 2/2006 | Anderson et al. | 701/50 |
| 2006/0224280 | A1 * | 10/2006 | Flanigan et al. | 701/2 |
| 2008/0004777 | A1 * | 1/2008 | Quigley | 701/50 |
| 2008/0059030 | A1 * | 3/2008 | Quigley et al. | 701/50 |
| 2008/0103662 | A1 * | 5/2008 | Pillar et al. | 701/50 |
| 2009/0265059 | A1 * | 10/2009 | Medwin et al. | 701/33 |

FOREIGN PATENT DOCUMENTS

| | | | | |
|---|---|---|---|---|
| JP | 2001131911 | A | * | 5/2001 |
| JP | 2004257043 | A | * | 9/2004 |
| JP | 4054267 | B2 | * | 2/2008 |
| WO | WO 0142872 | A2 | * | 6/2001 |
| WO | WO 02068989 | A1 | * | 9/2002 |
| WO | WO 02070343 | A2 | * | 9/2002 |
| WO | WO 03063537 | A1 | * | 7/2003 |

OTHER PUBLICATIONS

"Oshkosh Demonstrates ProPulse, the First Electric Hybrid—Drive Heavy Defense Truck," Oshkosh Truck Corp., Feb. 27, 2000 (2 pgs. ).*

"Onboard Computer—Mobius TTS Smarter Mobile Logistics on the Road," Cadec Corporation, Londonderry, NH, estimated date obtained of Aug. 8, 2001 (4 pgs.).*

"Palletized Load System (PLS)—Concrete Mobile Mixer Module," Product of Oshkosh Truck Corporation, see IDS for date information (2 pgs.).*

A Controller Area Network Bus Transceiver Behavioral Model for Network Design and Simulation; Prodanov, W. et al.; Industrial Electronics, IEEE Transactions on; vol. 56 , Issue: 9; Digital Object Identifier: 10.1109/TIE.2009.2025298 Publication Year: 2009 , pp. 3762-3771.*

Relaying Controller Area Network Frames over Wireless Internetworks for Automotive Testing Applications Johanson, M. et al.; Systems and Networks Communications, 2009. ICSNC '09. Fourth International Conference on Digital Object Identifier: 10.1109/ICSNC.2009.68; Publication Year: 2009 , pp. 1-5.*

A protocol for automatic node discovery in CANopen networks; Cena, G. et al..; Industrial Electronics, IEEE Transactions on vol. 50 , Issue: 3; Digital Object Identifier: 10.1109/TIE.2003.812281; Publication Year: 2003 , pp. 419-430.*

Hardware EDF scheduler implementation on controller area network controller; Shokry, H. et al.; Design and Test Workshop (IDT), 2009 4th International; Digital Object Identifier: 10.1109/IDT.2009.5404095; Publication Year: 2009 , pp. 1-6.*

Research on the energy-saving technology of concrete mixer truck; inxiang Zhao et al.; Industrial Electronics and Applications, 2009. ICIEA 2009. 4th IEEE Conference on; Digital Object Identifier: 10.1109/ICIEA.2009.5138867; Publication Year: 2009 , pp. 3551-3554.*

Teleoperation of a Mobile Robot Using a Force-Reflection Joystick With Sensing Mechanism of Rotating Magnetic Field Seung Keun Cho et al.; Mechatronics, IEEE/ASME Transactions on; vol. 15 , Issue: 1; Digital Object Identifier: 10.1109/TMECH.2009.2013848; Publication Year: 2010 , pp. 17-26.*

Passive control of an electrohydraulic actuator using an electrohydraulic passive valve; Krishnaswamy, K. et al.; American Control Conference, 2001. Proceedings of the 2001; vol. 5, Digital Object Identifier: 10.1109/ACC.2001.946270; Publication Year: 2001 , pp. 3932-3937 vol. 5.*

Suppressing operator-induced oscillations in manual control systems with movable bases; Sirouspour, M.R. et al.; Control Systems Technology, IEEE Transactions on; vol. 11 , Issue: 4; Digital Object Identifier: 10.1109/TCST.2003.813386 Publication Year: 2003 , pp. 448-459.*

Coordinate Frames in Robotic Teleoperation; Hiatt, L.M. et al.; Intelligent Robots and Systems, 2006 IEEE/RSJ International Conference on; Digital Object Identifier: 10.1109/IROS.2006.282130; Publication Year: 2006 , pp. 1712-1719.*

Bilateral matched impedance teleoperation with application to excavator control; Salcudean, S.E. et al.; Control Systems Magazine, IEEE; vol. 19 , Issue: 6; Digital Object Identifier: 10.1109/37.806913; Publication Year: 1999 , pp. 29-37.*

International Search Report and Written Opinion for Application No. PCT/US2006/042197, mailing date Apr. 12, 2007, 8 pages.

* cited by examiner

WIRELESS CONTROL SYSTEM FOR A LOAD HANDLING VEHICLE

FIELD OF THE INVENTION

The present invention relates generally to the field of wireless control systems and specifically to a wireless control system for controlling a vehicle subsystem of a vehicle such as a concrete placement vehicle, refuse vehicle, container handling vehicle, etc.

BACKGROUND OF THE INVENTION

Material or load handling vehicles such as refuse vehicles, concrete placement vehicles, and container or pallet handling vehicles include a number of subsystems that allow the vehicles to perform their intended functions. Typically, these subsystems are hardwired to a central control system such as a user interface, where an operator may control the subsystems. Hardwiring each subsystem throughout the vehicle to a central control system may result in several operational problems. For example, a completely hardwired system may increase spatial requirements for positioning the system, in addition to making other components or subsystems more difficult to access. Further, the number and length of wires present in a hardwired system may make diagnosis of a wiring problem difficult to locate. Additionally, a hardwired system will typically increase production costs in the form of materials and labor.

In addition to controlling vehicle subsystems, a central control can also operate to communicate information (e.g. diagnostic information) about a vehicle and its subsystems to an operator at a storage or maintenance location (e.g. central garage, fleet location, batch plant, central data center, etc.) typically this requires having an operator get inside the truck and plug in a status code reading device. The device may then tell the operator the status of various vehicle subsystems or the vehicle itself may indicate a status to the operator. Having an operator manually check each of the vehicles may take a significant amount of time and be cost ineffective.

Thus there is a need for a wireless vehicle control system that reduces the large amount of wiring that is typically run throughout a material or load handling vehicle, in order to control the vehicle subsystems. There is also a need for a control system on an material or load handling vehicle that is capable of sending the vehicle and subsystems status to a remote monitoring system so that vehicle information may be quickly and easily collected at a location remote from the vehicle.

SUMMARY OF THE INVENTION

One embodiment of the invention relates to a load handling vehicle having a wireless control system. The control system is configured to facilitate data transmission of a system command over a wireless communication link. The vehicle can include a load handling device for maneuvering a load. Examples of such maneuvering includes moving refuse in a bin, positioning concrete, controlling a bucket containing material, etc. The vehicle also includes an operator interface, including a directional controller and a control module. The directional controller is configured to receive the system command from a user and the control module is configured to process the system command. The vehicle also includes a first transceiver coupled to the operator interface. The first transceiver is configured to transmit the system command from the operator interface to the load handling device over the wireless communication link. The vehicle also includes a second transceiver coupled to the load handling device. The second transceiver is configured to receive the system command from the first transceiver. The load handling device is configured to perform a function in response to the system command provided through the directional controller.

Another embodiment of the invention relates to a control system for controlling a load handling device of a load handling vehicle. The load handling vehicle has a controller area network including a bus assembly. The control system is configured to facilitate data transmission using a radio frequency (RF) protocol, the data being transmitted over a wireless communication link. The system includes a control module coupled to the controller area network. The control module is configured to retrieve vehicle data from the bus assembly of the controller area network. The system also includes a first transceiver coupled to the control module. The first transceiver is configured to transmit the vehicle data over a wireless communication network. The system also includes a second transceiver configured to communicate with the first transceiver an inquiry relating to the vehicle data. The second transceiver is coupled to a remote monitoring system. The remote monitoring system is configured to facilitate analysis of the vehicle data received from the control module over the wireless communication network.

Another embodiment of the invention relates to a load handling vehicle including a control system configured to provide a wireless communication link. The vehicle includes a chassis, a body including an occupant compartment, a power source, a plurality of drive wheels coupled to the chassis, a plurality of vehicle subsystems, and a directional controller for configured to receive a command to maneuver a vehicle subsystem. The vehicle also includes a control module including a microprocessor. The control module is coupled to the directional controller, wherein the microprocessor is configured to process the command received from the directional controller. The vehicle also includes a controller area network including a bus assembly. The controller area network is coupled to the control module, wherein the control module is configured to receive vehicle data from the controller area network. The vehicle also includes a first transceiver coupled to the control module. The first transceiver is configured to facilitate transmission of the system command to at least one of the plurality of vehicle subsystems over the wireless communication link. The vehicle also includes a second transceiver coupled to at least one of the plurality of vehicle subsystems. The second transceiver is configured to receive the command from the first transceiver, wherein at least one of the vehicle subsystems is configured to execute a function in response to the command received by the directional controller.

Another embodiment of the invention relates to a refuse vehicle. The vehicle includes a power source; a body, including an occupant compartment and a container for receiving a load of refuse; and a refuse loader system. The refuse loader system includes a lift arm assembly coupled to the body; a fork assembly, coupled to the lift arm assembly, for handling a load of refuse; a compression apparatus for compacting the load of refuse in the container; and an operator interface including a control module, the control module being configured to process a system command received from an operator. The vehicle also includes a first interface module coupled to the control module of the operator interface. The first interface module is configured to provide transmission of the system command between the control module and the refuse loader system over a wireless communication network. The vehicle also includes a second interface module coupled to the refuse loader system. The second interface module is configured to receive the system command from the first interface module over the wireless communication network and deliver the system command to the refuse loader system. The refuse loader system is configured to perform an activity in response to the command.

Another embodiment of the invention relates to a concrete placement vehicle for distributing concrete. The vehicle includes a chassis; a power source; a plurality of drive wheels coupled to the chassis; a body coupled to the chassis, the body including an occupant compartment; and a plurality of vehicle subsystems, including a concrete discharge system. The concrete discharge subsystem includes a mixing drum; at least one hydraulic pump and motor coupled to the mixing drum; a boom assembly coupled to the mixing drum, wherein the boom is configured to discharge concrete from the mixing drum; and a control module including a microprocessor, wherein the microprocessor is configured to process a system command received from an operator. The vehicle also includes a controller area network including a bus assembly, the controller area network being coupled to the control module. The control module is configured to receive vehicle data from the controller area network. The vehicle also includes a first transceiver coupled to the control module. The first transceiver is configured to provide transmission of the system command between the control module and the concrete discharge system over a wireless communication network. The vehicle also includes a second transceiver coupled to the concrete discharge system. The second transceiver is configured to receive the system command from the first transceiver and to provide the system command to the concrete discharge system. The concrete discharge system is configured to perform a function in response to the system command.

Another embodiment of the invention relates to a refuse vehicle for handling and transporting a load of refuse. The vehicle includes a chassis; a power source; a plurality of drive wheels coupled to the chassis; a body coupled to the chassis, the body including an occupant compartment and a container for receiving the load of refuse; and a plurality of vehicle subsystems, including a refuse loader system. The refuse loader system includes a lift arm assembly coupled to the body; a hydraulic cylinder configured to pivot the lift arm assembly; a gripping apparatus, coupled to the lift arm assembly, for handling the refuse load; and a compression apparatus for compacting the load of refuse in the container. The vehicle also includes a control module including a microprocessor, wherein the microprocessor is configured to process a system command received from an operator. The vehicle also includes a controller area network including a bus assembly. The controller area network is coupled to the control module, wherein the control module is configured to receive vehicle data from the controller area network. The vehicle also includes a first transceiver coupled to the control module. The first transceiver is configured to transmit a system command from the control module to at least one of the plurality of vehicle subsystems over a wireless communication network. The control module is further configured to provide transmission of the vehicle data to a remote monitoring system over the wireless communication network.

Another embodiment of the invention relates to a refuse vehicle. The vehicle includes a power source; a body, the body including an occupant compartment and a container having a rear opening for receiving the load of refuse; and a refuse loader system. The refuse loader system includes a lift arm assembly mounted near the rear opening of the container; a hopper; a tailgate assembly; and a compression apparatus for compacting the load of refuse in the container. The vehicle also includes a control module including a microprocessor. The microprocessor is configured to process a system command received from an operator. The vehicle also includes a first interface module coupled to the control module of the operator interface. The first interface module is configured to provide transmission of the system command between the control module and the refuse loader system over a wireless communication network. The vehicle also includes a second interface module coupled to the refuse loader system. The second interface module is configured to receive the system command from the first interface module and provide the system command to the refuse loader system.

Another embodiment of the invention relates to a concrete placement vehicle. The vehicle includes a power source; a body; and a concrete discharge system. The concrete discharge system includes a mixing drum and a boom assembly coupled to the mixing drum, wherein the boom assembly is configured to discharge concrete from the mixing drum. The vehicle also includes an operator interface including a control module, wherein the control module is configured to process a system command received from an operator. The vehicle also includes a controller area network including a bus assembly. The controller area network is coupled to the control module, wherein the control module is configured to receive vehicle data from the controller area network. The vehicle also includes a first transceiver coupled to the control module. The first transceiver is configured to provide transmission of the system command between the control module and the concrete discharge system over a wireless communication network. The control module is further configured to provide transmission of the vehicle data to a remote monitoring system over the wireless communication network.

Another embodiment of the invention relates to a vehicle. The vehicle includes a chassis supported by a plurality of wheels; an electronically controlled load handler supported by the chassis; a first transceiver located on the vehicle and configured to receive control signals configured to control the load handler; and a second transceiver located on the vehicle and coupled to the load handler. The first and second transceivers are configured transmit signals there between wirelessly and the second is further configured to transmit signals representative of the control signals to the load handler.

DETAILED DESCRIPTION OF THE EXEMPLARY EMBODIMENTS

Figure 1:
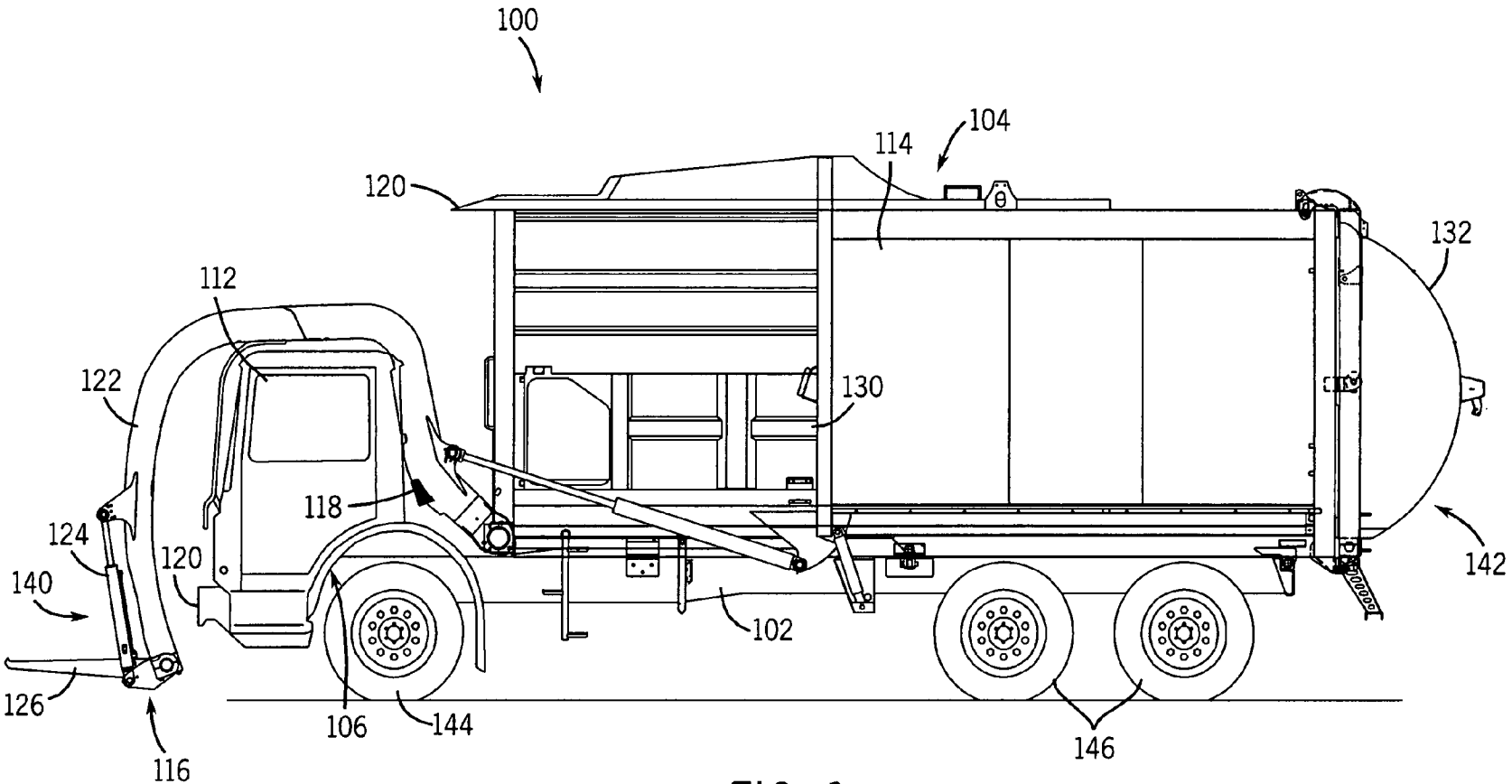
FIG. 1 is a schematic view of a refuse vehicle including a control system for controlling a vehicle subsystem according to one exemplary embodiment.

FIG. 1 shows a nonexclusive exemplary embodiment of a load handling vehicle, specifically a refuse vehicle 100 for handling and transporting a load of refuse. Refuse vehicle 100 is a heavy-duty load handling vehicle having a control system for controlling and monitoring the vehicle load handling devices or vehicle subsystems (hereafter referred to as vehicle subsystems). For example, refuse vehicle 100 provides a wireless communication network or link 200 (FIG. 2) to facilitate communication with the vehicle subsystems. Wireless communication network 200 is preferably provided as a wireless communication link using wireless technology such as a Bluetooth communications protocol, an 802.11 communications protocol, or other known wireless protocols, for controlling various features and functions of vehicle 100. Vehicle 100 generally includes a chassis 102, a body 104, a power source 106, a series of wheels (illustrated as steerable wheels 144 and drive wheels 146), a vehicle subsystem (illustrated as exemplary subsystems 116, 118, and 120), and a control system 202 (shown in FIG. 2).

It should be understood that, although the control systems for controlling and monitoring the vehicle subsystems will be described in detail herein with reference to refuse vehicle 100, one or more of the systems for controlling the refuse vehicle 100 disclosed herein may be applied to, and find utility in, other types of load handling vehicles as well. For example, one or more of the systems for controlling the subsystems of the refuse vehicle may be suitable for use with concrete placement vehicles, snow removal vehicles, wrecker/tow and recovery vehicles, mobile cranes, other mobile lift devices, backhoes, bucket trucks, emergency response vehicles (e.g., aircraft rescue vehicles, ambulance vehicles, or firefighting vehicles), military vehicles, or any other load handling vehicle which would benefit from the use of wireless data transmission with a vehicle subsystem.

Referring to FIG. 1, chassis 102 is generally configured to support body 104, power source 106, vehicle subsystems 116, 118, and 120, and control system 202 on a plurality of wheels 144 and 146. According to an exemplary embodiment, chassis 102 may include one more sections that are fastened together, for example by welding or bolts, to form a frame, as well as general drive train parts of vehicle 100, for example axles, a drive shaft, and suspension components (not shown). In such an exemplary embodiment, the chassis 102 generally includes first and second frame members (not shown) that are arranged as two generally parallel chassis rails extending in a fore and aft direction between a first end 140 (a forward portion of the vehicle 100) and a second end 142 (a rearward portion of the vehicle 100). The first and second frame members are configured as elongated structural or supportive members (e.g., a beam, channel, tubing, extrusion, etc.). The first and second frame members are spaced apart laterally and define a void or cavity (not shown). The cavity, which generally constitutes the centerline of the vehicle 100, may provide an area for effectively concealing or otherwise mounting certain components of the vehicle 100 (e.g., the power source 106, a vehicle subsystem, drive train components, etc.). In other exemplary embodiments, chassis 102 may be of other configurations such as including a single section instead of a multiple section frame, such as a monocoque design (e.g., a uni-body construction). In various exemplary embodiments, chassis 102 may be composed of any combination of suitable materials with enough combined rigidity to support the components of vehicle 100 including various metals and synthetics including steel, aluminum, plastic, fiberglass, or any material of like properties or other combination thereof.

Refuse vehicle 100 is further shown as including a body 104. Body 104 includes an occupant compartment 112 and a container 114 in this exemplary embodiment. Body 104 is preferably secured on chassis 102 and houses the vehicle subsystems 116, 118, and 120, power source 106, and control system 202. Occupant compartment 112 is carried and/or supported at the first end 140 of the chassis 102 and is configured to provide a seating area for a vehicle occupant (i.e., driver, operator, etc.). Occupant compartment 112 includes controls associated with the manipulation of the vehicle 100 (e.g., steering controls, throttle controls, etc.) and provides access to controls that may be used to operate the functions of vehicle 100, including access to an operator interface 204 of control system 202. Container 114 is typically configured to receive and store a load of refuse for future disposal at a refuse dumpsite. Container 114 is shown on a front loading refuse vehicle in FIG. 1; however, in other embodiments container 114 may be configured as a container for a side-loading or rear-loading refuse vehicle. In various exemplary embodiments, body 104 may be composed of any material such as various metals and synthetics including steel, aluminum, plastic, fiberglass, or any material of like properties or other combination thereof.

Power source 106 provides electrical power at least to control system 202 and is housed in body 104 and secured by chassis 102. Power source 106 is typically housed under occupant compartment 112, however in other exemplary embodiments power source 106 may be located at other points in vehicle 100 such as being positioned in front of or behind occupant compartment 112. In one exemplary embodiment, power source 106 may only provide electrical power to control system 202, while in another exemplary embodiment, power source 106 may also power the drive train of vehicle 100. In one exemplary embodiment, power source 106, may be the engine of vehicle 100. In other exemplary embodiments, power source may be a battery, for example the starter battery of vehicle 100 or an auxiliary battery.

A plurality of wheels 144 and 146 are rotatably coupled to chassis 102 and are configured to support the weight of chassis 102, body 104, power source 106 and control system 202. Wheels 144 and 146 are also coupled to the vehicle drive train and configured to propel vehicle 100 as desired by an operator. In various exemplary embodiments drive wheels may be vary in number and/or configuration depending on the embodiment of vehicle 100. According to the embodiment illustrated, the vehicle 100 utilizes two tandem wheel sets 146 at the second end 142 of vehicle 100 and one wheel set 144 at the first end 140 of the vehicle 100. In this configuration, the wheel set 144 at the first end 140 is steerable while the wheels sets 146 are configured to be driven by the vehicle drive train. According to various exemplary embodiments, vehicle 100 may have any number of wheel configurations including, but not limited to, four, eight, or eighteen wheels, wherein any or all of the drive wheels are configured to be steerable.

For purposes of this disclosure a vehicle subsystem refers to any apparatus or device that facilitates the operation of a function of vehicle 100. A vehicle subsystem may include a refuse loader system 116, a remote control system 118, and a lighting system 120 (for example headlights, taillights, turn lights, and strobe lights). In other exemplary embodiments, a vehicle subsystem may also include one or more of a group of systems including a hydraulic system, a work light system, a proximity sensor system, an engine control system, a transmission control system, a braking system, and a central tire inflation system.

Refuse loader system 116 retrieves a load of refuse and stores the load in container 114 for future disposal. Refuse loader system 116 includes a lift arm assembly 122, a hydraulic cylinder 124, a gripping apparatus 126, a hopper 128, a compression apparatus 130, and a tailgate assembly 132. Lift arm assembly 122 is preferably coupled to body 104 and is configured to pivot, based upon the force applied from hydraulic cylinder 124, in order to raise and insert a load of refuse handled by gripping apparatus 126, which is coupled to lift arm assembly 122, into hopper 128 where it is stored in container 114. Compression apparatus 130 is configured to compact refuse stored in container 114 in order to save space within container 114. Refuse in container 114 may be transported to any desired dumping site, at which container 114 is lifted by a hydraulic lift and refuse falls out of container 114 through an opened tailgate assembly 132.

While the illustrated exemplary embodiment shows refuse loader system 116 to be a front loading system, in another exemplary embodiment, a refuse loader system may be provided with a side loading system with lift arm assembly 122 pivoting on the side of body 104 to insert a load of refuse into hopper 128. In still another exemplary embodiment, refuse loader system may be a rear loading system with lift arm assembly 122 pivoting on a rear section of body 104 to insert a load of refuse into hopper 128. While the illustrated exemplary embodiment shows gripping apparatus 126 to be a fork assembly, in other exemplary embodiments gripping apparatus 126 may be of another configuration such as a plurality of members configured to grab or squeeze together and hold a load of refuse, for example a claw. While hopper 128 is illustrated as being in a relatively forward area of body 104, in other exemplary embodiments, hopper 128 may be further back or forward on body 104 so long as refuse loader system 116 is capable of inserting refuse into hopper 128 for storage and compression in container 114. In one exemplary embodiment compression apparatus 130 may be a packing blade or paddle, while in other exemplary embodiments apparatus 130 may be of any past, present, or future design that is capable of compacting refuse stored in container 114. In a number of exemplary embodiments, tailgate assembly 132 may automatically open prior to or during the raising of container 114 for dumping or tailgate assembly 132 may remain closed even when container is raised until opened manually, for example by lever or electric switch.

Control system 202 is configured to control a vehicle subsystem 206 of vehicle 100 using wireless communication network 200. Control system 202 may both send and receive data to and from subsystems 206. Control system 202 includes operator interface 204, a controller area network (CAN) 208, a first transceiver or interface module 210, and a second transceiver or interface module 212 associated with each subsystem 206.

Operator interface 204 may be located in occupant compartment 112 and is coupled to first transceiver 210 and controller area network 208. Interface 204 includes a control module 214 and a directional controller 216. Control module 214 preferably processes operator input from directional controller 216 as well as input from first transceiver 210 and CAN 208 using a microprocessor. Based on input from directional controller 216, control module 214 may compute which subsystem 206 to control or what data or command to send to one or more of subsystems 206. In one exemplary embodiment, the microprocessor of control module 214 may be a programmable digital processor such as an instruction based processor, a field programmable gate array, or a programmable logic array. In another exemplary embodiment directional controller 216 may be a joystick. In other exemplary embodiments directional controller 216 may be of another configuration including a mouse, lever, switch, touchpad, or touch screen.

CAN 208 is configured to communicate vehicle data to control module 214. CAN 208 includes a bus assembly that facilitates the communication of vehicle data via a wired connection. In another exemplary embodiment, the communication of vehicle data may be via a wireless connection. In various exemplary embodiments the vehicle data received from CAN 208 may be related to one or more of a group including vehicle fault codes, vehicle diagnostic data, service parameter data, proximity sensor data, vehicle usage data, and system alarms.

First transceiver 210 is preferably coupled to operator interface 204 and is configured to transmit data such as a system command from control module 214 to at least one vehicle subsystem 206 over wireless communication network 200. Second transceiver 212 is coupled to at least one vehicle subsystem 206 and may be configured to receive data from control module 214 and transmit data from at least one vehicle subsystem 206 to control module 214 via wireless network 200. In one exemplary embodiment, transceivers 210 and 212 may operate in a wireless frequency range between 900 MHz and 2.5 GHz. In another exemplary embodiment, transceivers 210 and 212 may operate in a range between 900 MHz and 960 MHz. In still another exemplary embodiment, transceivers 210 and 212 may operate in a range between 2.3 GHz and 2.5 GHz. In one exemplary embodiment, transceivers 210 and 212 may provide short-range data transmission. For purposes of this exemplary embodiment, short-range data transmission may have a functional range within 200 feet. In another exemplary embodiment, transceivers 210 and 212 may have a functional range within 50 feet. In still another exemplary embodiment, transceivers 210 and 212 may have a functional range within 30 feet. In other exemplary embodiments, transceivers 210 and 212 may have provide non-short-range data transmission with a functional range of greater than 200 feet. In various exemplary embodiments, transceivers 210 and 212 may vary in number and/or configuration based on the embodiment of the system and may be of any past, present, or future design that is capable of wireless communication in one or more of the above frequency ranges.

Figure 2:
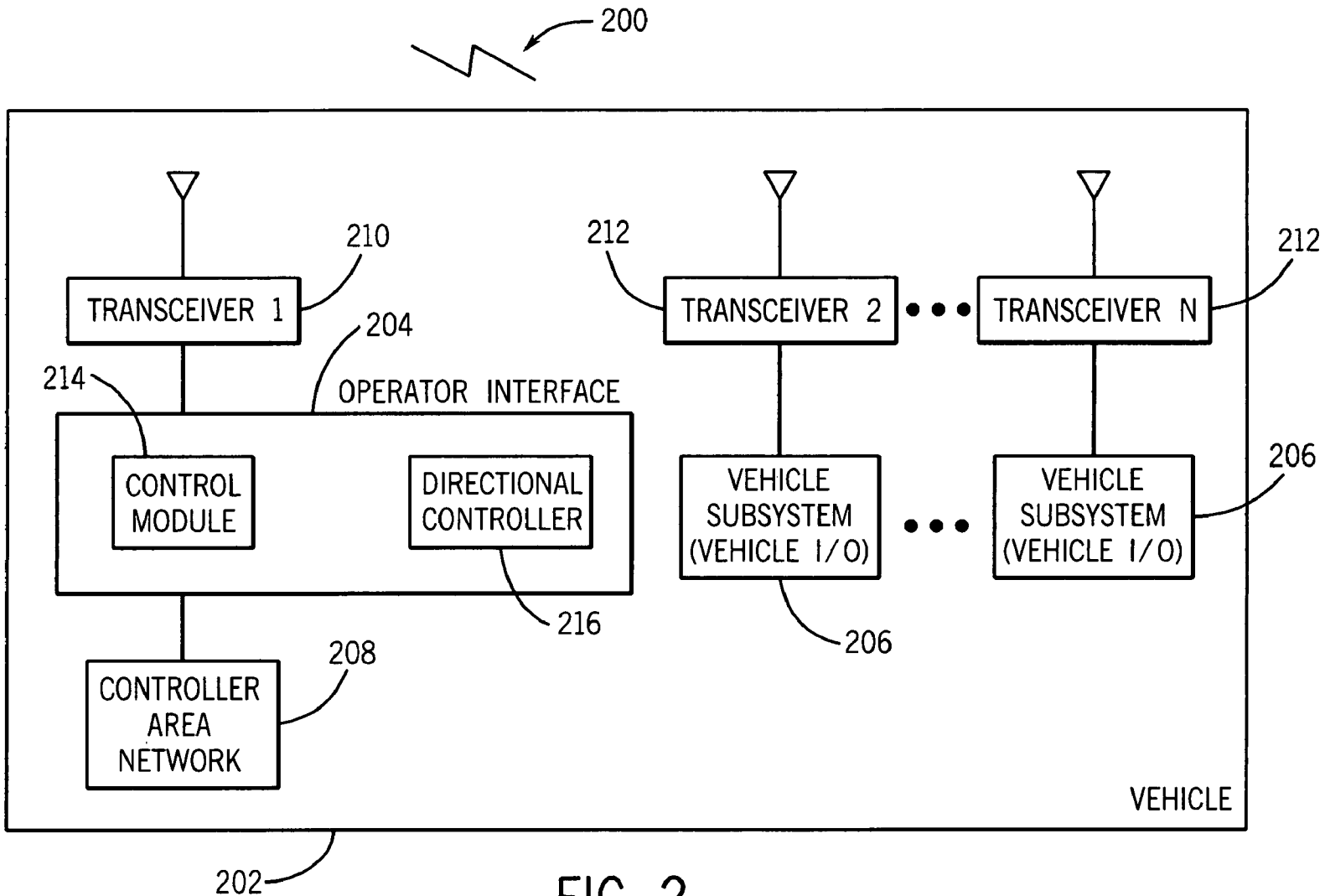
FIG. 2 is a block diagram of a control system for controlling a vehicle subsystem of the vehicle of FIG. 1 according to one exemplary embodiment.
Figure 3:
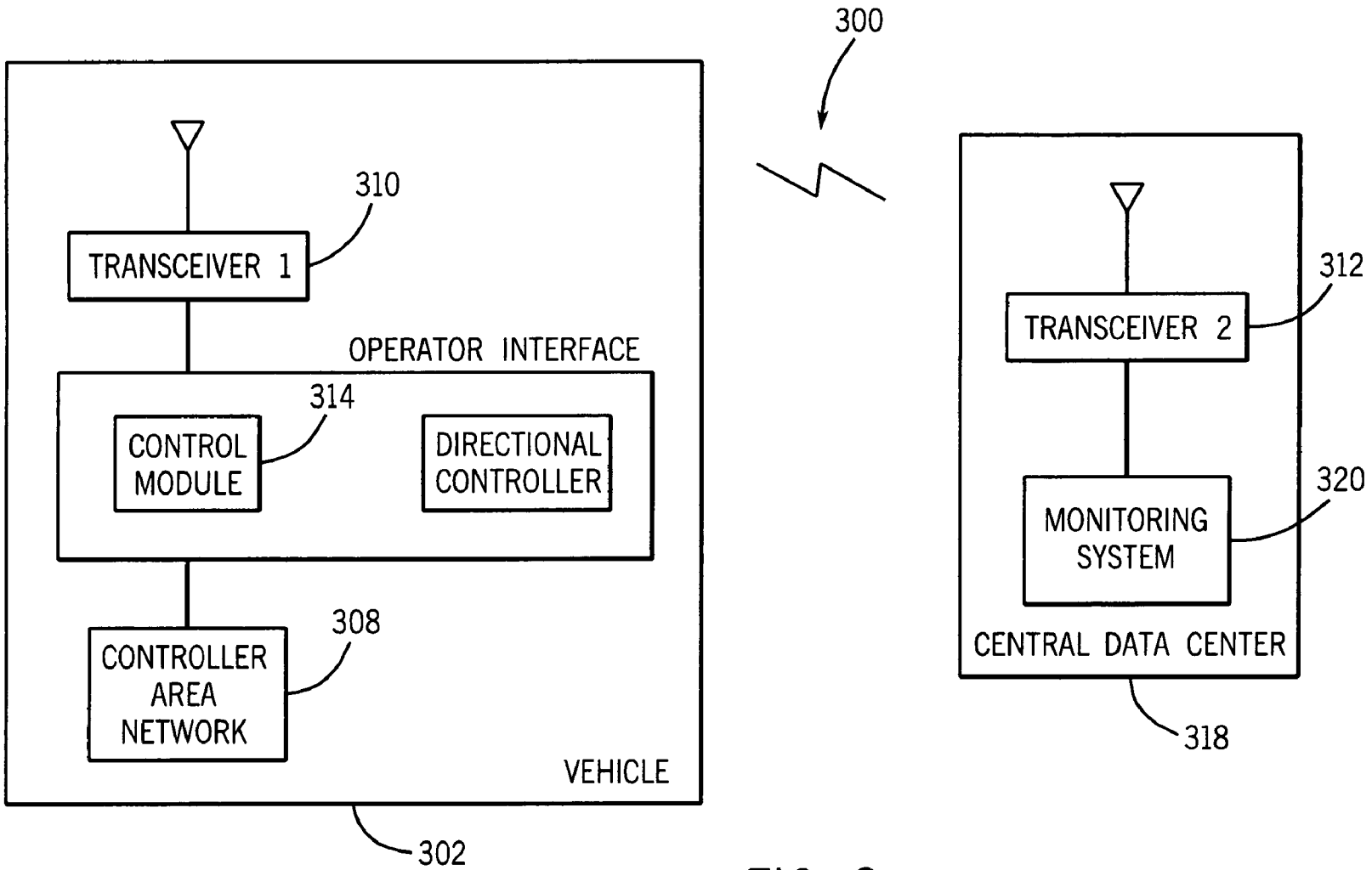
FIG. 3 is a block diagram of a control system for interfacing the vehicle of FIG. 1 with a monitoring system according to one exemplary embodiment.

Referring to FIG. 3, another exemplary embodiment 302 of control system 202 is shown. Each function of system 202 of FIG. 2 is similar to the system of FIG. 3. In this exemplary embodiment, a first transceiver 310 is now configured to transmit vehicle data from a control module 314 over a wireless network 300 to a central data center 318. Central data center 318 includes a second transceiver 312 that is coupled to a monitoring system 320. Second transceiver 312 is configured to send an initial request for vehicle data and to receive vehicle data from a control module 314 via a bus assembly of a controller area network (CAN) 308. In one exemplary embodiment, the status request may be sent at all times by second transceiver 312 where vehicle 100 may receive the signal when within a predefined range. In other exemplary embodiments, status request may only be sent to vehicle 100 when triggered by an event such as if vehicle 100 is sensed by a proximity sensor or drives over a pressure plate. Monitoring system 320 may include a computer configured to analyze the vehicle data received by transceiver 312. In various exemplary embodiments, monitoring system 320 may display the vehicle data or related calculations on a screen, trigger an alert, or automatically cause transceiver 312 to send data back to vehicle 100.

It is noted that while in the illustrated exemplary embodiments of FIGS. 2 and 3, vehicle 100 may use wireless communication with control system 202 to issue commands to subsystems 206 or with control system 302 to send vehicle data to monitoring system 320, in other exemplary embodiments, vehicle 100 may include a control system, whether it be integrated or segregated components, capable of using both control systems 202 and 302 to both control subsystems 206 and send vehicle data to monitoring system 320.

Figure 4:
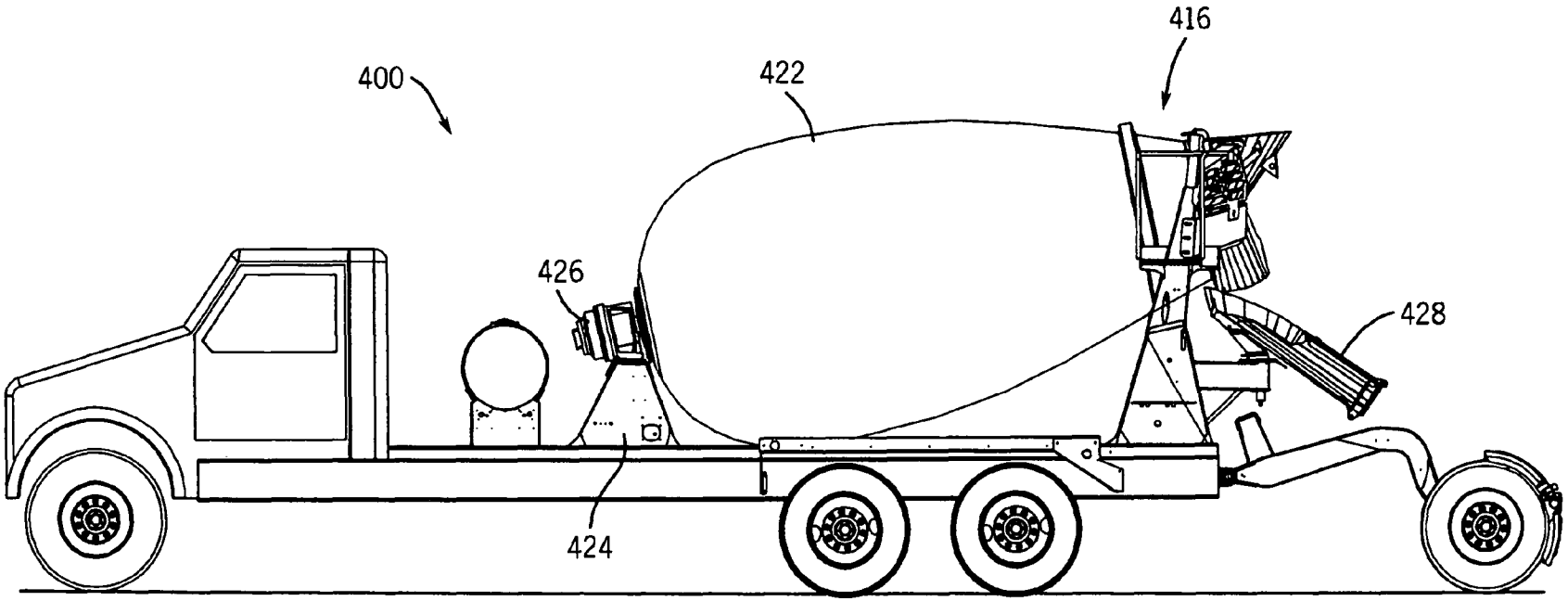
FIG. 4 is a schematic view of a concrete placement vehicle including a control system for controlling a vehicle subsystem according to one exemplary embodiment.

Referring to FIG. 4, a concrete placement vehicle 400 is shown according to another exemplary embodiment of a load handling vehicle. Vehicle 400 includes each system of vehicle 100 and uses control systems 202 and/or 302, however refuse loader system 116 is preferably substituted with a concrete discharge system 416. Each subsystem may be controlled by a module similar to control module 214 with commands issued by transceivers over a wireless network. The status of vehicle 400 may be sent to a monitoring system such as monitoring system 320 via wireless transceivers based on a status request from monitoring system 320. In one exemplary embodiment, the status request may be sent at all times by second transceiver 312 where vehicle 400 may receive the signal when within a predefined range. In other exemplary embodiments, status request may only be sent to vehicle 400 when triggered by an event such as if vehicle 400 is sensed by a proximity sensor or drives over a pressure plate.

Concrete discharge system 416 includes a mixing drum 422, a hydraulic pump 424, a motor 426, and a boom assembly 428. At least one hydraulic pump 424 and motor 426 may be configured to rotate mixing drum 422 in order to keep concrete stored within drum 422 from solidifying. Boom assembly 428 is preferably coupled to mixing drum and configured to discharge concrete from mixing drum 422 by providing a channel for the concrete to flow out of drum 422. In various exemplary embodiments, concrete placement vehicle 400 may include other subsystems or controls, for example water add controls, chute controls, auxiliary axle controls, hopper controls, slump monitoring systems, and mixer and other body controls. Such other subsystems are preferably controlled and monitored by control system 202 and/or control system 302.

It is noted that in addition to refuse vehicle 100 and concrete placement vehicle 400, in other exemplary embodiments other types of load handling vehicles, for example wreckers, tow vehicles, dump trucks, military vehicles, snow removal vehicles, cranes or mobile lift vehicles, aerial-lift vehicles, backhoes, excavators, loaders, or tractors may incorporate the functions and concepts of wireless subsystem control and wireless system monitoring. In these exemplary embodiments, such load handling vehicles preferably include a material or load handling device or assembly to facilitate the load handling process such as a lift arm assembly, fork assembly, claw, boom assembly, blade, or bucket. In still other exemplary embodiments, the functions and concepts of wireless subsystem control and wireless system monitoring may be incorporated in vehicles other than load handling vehicles such as fire trucks, ambulances, or other medical care or emergency rescue vehicles.

Figure 5:
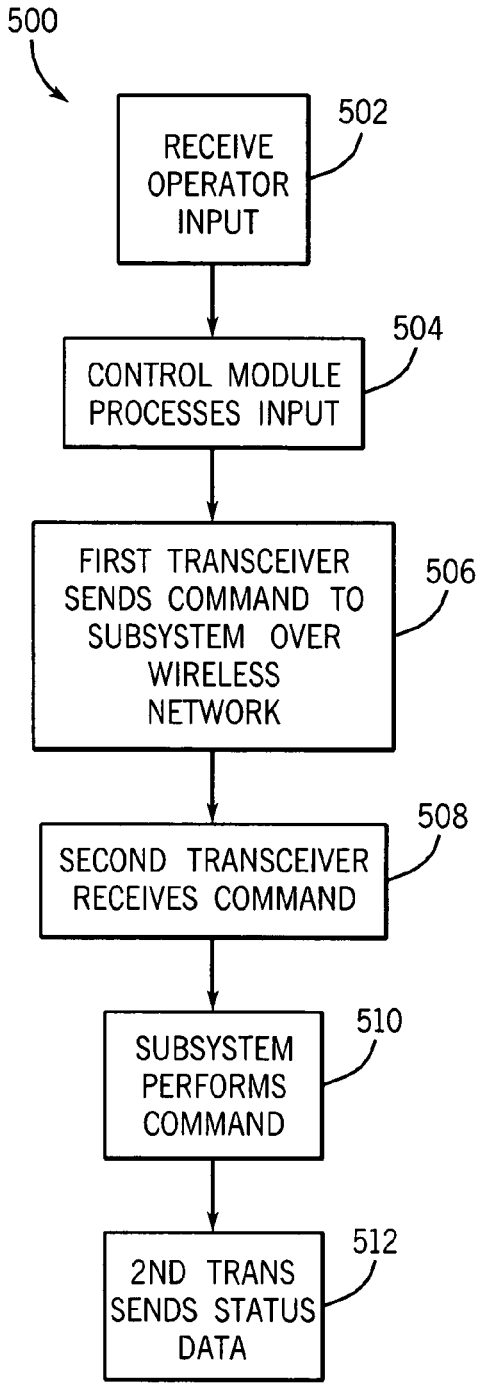
FIG. 5 is a flowchart illustrating the wireless data transmission between the operator interface and transceivers of the control system of FIG. 2 according to one exemplary embodiment.

Referring to FIG. 5, a process 500 for wireless transmission of commands to one or more subsystems 206 is shown. At step 502, control module 214 receives operator input from directional controller 216. In one exemplary embodiment, this input may be an electrical signal converted from a mechanical motion of directional controller 216. In various exemplary embodiments, this electrical signal may be an analog or digital signal for processing by control module 214.

At step 504, control module 214 processes the received input. In one exemplary embodiment, this processing may include interpretation of with which of one or more subsystems 206 to interact. In another exemplary embodiment, this processing may include interpretation of what data or command to send to one or more subsystems 206.

At step 506, first transceiver 210 sends a command to one or more subsystems 206 over wireless network 200. In one exemplary embodiment, the command may be sent with encoding that only allows the intended subsystems 206 to receive the command. In another exemplary embodiment, the command may be sent without encoding with each subsystem 206 of vehicle 100 or 400 interpreting whether to use the command or not.

At step 508, second transceiver 212 receives the command sent by first transceiver 210. In the exemplary embodiment of step 506 where the signal is not encoded, second transceiver 212 may interpret whether or not to use the issued command.

At step 510, each appropriate subsystem 206 performs the command received from second transceiver 212. The command generally is preferably used to operate the specific functionality of subsystem 206. It is noted that in other exemplary embodiments, more than one command may be issued by control module 214 at any given time, in order to simultaneously control multiple subsystems 206 with different commands.

At step 512, second transceiver 212 is configured to provide vehicle status data back to control module 214. Vehicle status data may be provided in the form of vehicle fault codes, vehicle diagnostic data, service parameter data, proximity sensor data, vehicle usage data, or system alarms to inform control module 214 vehicle subsystem 206 has performed an issued command or to inform control module 214 that a sensor has been triggered.

Figure 6:
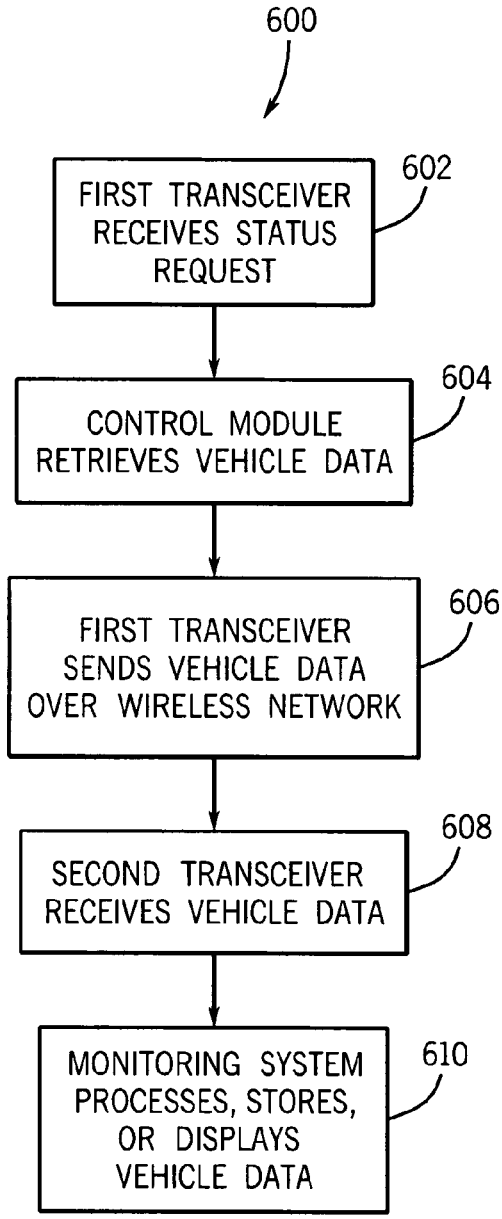
FIG. 6 is a flowchart illustrating the wireless data transmission between the vehicle of FIGS. 1 or 4 and a monitoring system as shown in FIG. 3 according to one exemplary embodiment.

Referring to FIG. 6, a process 600 for wireless transmission of vehicle data to a monitoring system 320 is shown. At step 602, first transceiver 310 receives a vehicle status request from second transceiver 312 of monitoring system 320 over wireless network 300 (see FIG. 3). In one exemplary embodiment, this status request may be sent at all times by second transceiver 312 where vehicle 100 or 400 may receive the signal when within a predefined range. In other exemplary embodiments, status request may only be sent to vehicle 100 or 400 when triggered by an event such as if vehicle 100 or 400 is sensed by a proximity sensor or drives over a pressure plate.

At step 604, control module 314 retrieves vehicle data corresponding to the status request from the bus assembly of CAN 308. The vehicle data may be received in the form of vehicle fault codes, vehicle diagnostic data (e.g. the number of panic stops, system vitals, vehicle subsystem failures, etc.), service parameter data, proximity sensor data, vehicle usage data, or system alarms. In one exemplary embodiment, control module 314 may directly send the retrieved data to monitoring system 320 via first transceiver 310. In another exemplary embodiment, control module 314 may process or format the vehicle data before sending.

At step 606, first transceiver 310 sends vehicle data to monitoring system 320 over wireless network 300. In one exemplary embodiment, the data may be sent with encoding that only allows monitoring system 320 to receive the data. In another exemplary embodiment, the command may be sent without encoding while system 320 interprets whether to use the data or not. At step 608, second transceiver 312 receives the data sent by transceiver 310.

At step 610, monitoring system 320 handles the data received from second transceiver 312. In one exemplary embodiment, monitoring system 320 may process the vehicle data for statistical purpose, to trigger an alert, or to send back to vehicle 100 or 400 as a system command. In another exemplary embodiment, system 320 may store the vehicle data for later use, such as for statistical or historical purposes. In still another exemplary embodiment, system 320 may display the vehicle data on a screen for viewing by an operator.

Figure 7:
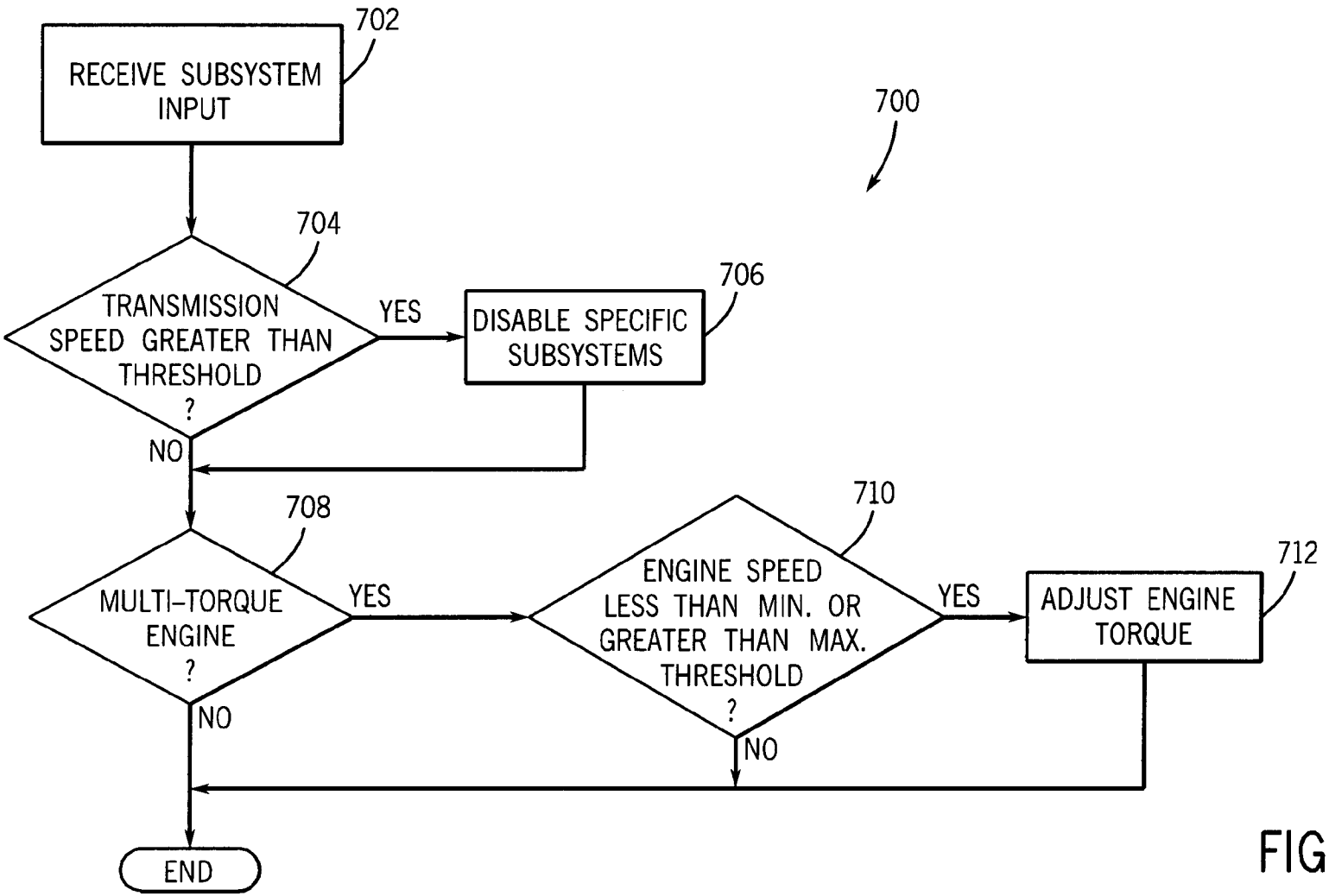
FIG. 7 is a flowchart illustrating the disabling of a subsystem and adjustment of the vehicle engine of FIGS. 1 or 4 according to one exemplary embodiment.

Referring to FIG. 7, a method 700 for disabling a vehicle subsystem 206 and adjustment of the vehicle engine is shown. At step 702, control module 214 receives input from vehicle subsystems 206 over the bus assembly of CAN 208. In one exemplary embodiment, control module 214 may receive data related to a transmission speed. In another exemplary embodiment, control module 214 may receive data related to the type of engine or an engine speed. In other exemplary embodiments, control module 214 may receive both engine and transmission data or other vehicle data. In various exemplary embodiments, the data received from subsystems 206 may be requested by module 214 or subsystems 206 may automatically send the data.

At step 704, control module 214 compares transmission speed data with a predefined speed threshold value. If the transmission speed is greater than the predetermined speed threshold, value, it may be undesirable to operate specific ones of subsystems 206 such as refuse loader system 116 or concrete discharge system 416.

If the transmission speed is greater than the speed threshold, at step 706 control module 214 preferably disables the predetermined ones of vehicle subsystems 206. If the transmission speed is not greater than the speed threshold, vehicle subsystems 206 are preferably not be disabled.

At step 708, control module 214 determines whether the vehicle engine is a multi-torque engine or not. In one exemplary embodiment, data on the type of engine may be preprogrammed into control module 214. In another exemplary embodiment, data on the type of engine may be sent the vehicle engine or an engine control system.

If the engine is a multi-torque engine, at step 710 control module 214 compares engine speed data to minimum and maximum speed thresholds. If the engine speed is less than the minimum threshold or greater than the maximum threshold, then at step 712 control module 214 may adjust the vehicle engine torque. If the engine speed does not exceed either threshold, then the vehicle engine torque preferably is not adjusted.

Although specific shapes of each element have been set forth in the drawings, each element may be of any other shape that facilitates the function to be performed by that element. For example, tailgate assembly 132 is shown to have a generally hemispherical shape, however, in other embodiments tailgate assembly 132 may be of a prismatic or curvilinear shape.

Although vehicle 100 is illustrated as including multiple features utilized in conjunction with one another, vehicle 100 may alternatively utilize less than all of the noted mechanisms or features. For example, in other exemplary embodiments, hydraulic cylinder 124 may be omitted and replaced with a system of pulleys coupled to a motor in order to operate lift arm assembly 122.

For purposes of this disclosure, the term "coupled" means the joining of two components (electrical or mechanical) directly or indirectly to one another. Such joining may be stationary in nature or movable in nature. Such joining may be achieved with the two components (electrical or mechanical) and any additional intermediate members being integrally defined as a single unitary body with one another or with the two components or the two components and any additional member being attached to one another. Such joining may be permanent in nature or alternatively may be removable or releasable in nature.

The present disclosure has been described with reference to example embodiments, however workers skilled in the art will recognize that changes may be made in form and detail without departing from the spirit and scope of the invention. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example is manifestly intended to be as broad as possible. For example, unless specifically otherwise noted a single particular element may also encompass a plurality of such particular elements.

It is also important to note that the construction and arrangement of the elements of the system as shown in the preferred and other exemplary embodiments is illustrative only. Although only a certain number of embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the assemblies may be reversed or otherwise varied, the length or width of the structures and/or members or connectors or other elements of the system may be varied, the nature or number of adjustment or attachment positions provided between the elements may be varied. It should be noted that the elements and/or assemblies of the system may be constructed from any of a wide variety of materials that provide sufficient strength or durability. Accordingly, all such modifications are intended to be included within the scope of the present disclosure. Other substitutions, modifications, changes and omissions may be made in the design, operating conditions and arrangement of the preferred and other exemplary embodiments without departing from the spirit of the present subject matter.

What is claimed is:

1. A load handling vehicle having a wireless control system, wherein the control system is configured to facilitate data transmission of a system command over a wireless communication link, the vehicle comprising:

a load handling device for maneuvering a load;

an operator interface, including a directional controller and a control module, the directional controller being configured to receive the system command from a user, wherein the control module is configured to process the system command;

a first transceiver located on the vehicle and coupled to the operator interface, wherein the first transceiver is configured to transmit the system command from the operator interface to the load handling device over the wireless communication link; and a second transceiver located on the vehicle and coupled to the load handling device, the second transceiver being configured to receive the system command from the first transceiver, wherein the load handling device is configured to perform a function in response to the system command provided through the directional controller.

2. The load handling vehicle according to claim 1, wherein the control module includes a programmable digital processor.

3. The load handling vehicle according to claim 1, wherein the directional controller is a joystick.

4. The load handling vehicle according to claim 1, further including a controller area network, the controller area network being configured to provide vehicle data to the control module.

5. The load handling vehicle according to claim 4, wherein the first transceiver is configured to transmit the vehicle data over the wireless communication network to a remote monitoring system.

6. The load handling vehicle according to claim 4, wherein the first transceiver is configured to receive an inquiry relating to the vehicle data from a remote transceiver, the remote transceiver being coupled to a remote monitoring system, the remote monitoring system being configured to facilitate analysis of the vehicle data received from the control module over the wireless communication link.

7. The load handling vehicle according to claim 1, wherein the control system is configured to include a unique internet protocol (IP) address.

8. The load handling vehicle according to claim 1, wherein the wireless communication link operates in a frequency range between 900 MHz to 960MHz.

9. A control system for controlling a load handling device of a load handling vehicle, the load handling vehicle having a controller area network including a bus assembly, the control system being configured to facilitate data transmission using a radio frequency (RF) protocol, the data being transmitted over a wireless communication link, the system comprising:

a control module coupled to the controller area network, wherein the control module is configured to retrieve vehicle data from the bus assembly of the controller area network;

a first transceiver located on the vehicle and coupled to the control module, wherein the first transceiver is configured to transmit the vehicle data over a wireless communication network; and a remote transceiver configured to communicate with the first transceiver an inquiry relating to the vehicle data, wherein the remote transceiver is coupled to a remote monitoring system, the remote monitoring system being configured to facilitate analysis of the vehicle data received from the control module over the wireless communication network.

10. The control system according to claim 9, wherein the wireless communication network operates in a frequency range between 900 MHz to 960 MHz.

11. The control system according to claim 9, wherein the control module includes a programmable digital processor.

12. The control system according to claim 9, wherein the control system of the vehicle is identifiable by a unique internet protocol (IP) address.

13. The control system according to claim 9, wherein the vehicle data comprises the following: vehicle fault codes, vehicle diagnostic data, service parameter data, proximity sensor data, vehicle usage data, and system alarms.

14. A load handling vehicle, including a control system configured to provide a wireless communication link, the vehicle comprising:

a chassis;

a body including an occupant compartment;

a power source;

a plurality of drive wheels coupled to the chassis;

a plurality of vehicle subsystems;

a directional controller configured to receive a command from a user, in order to maneuver a vehicle subsystem;

a control module including a microprocessor, the control module being coupled to the directional controller, wherein the microprocessor is configured to process the command received from the directional controller;

a controller area network including a bus assembly, the controller area network being coupled to the control module, wherein the control module is configured to receive vehicle data from the controller area network;

a first transceiver located on the vehicle and coupled to the control module, the first transceiver being configured to facilitate transmission of the command to at least one of the plurality of vehicle subsystems over the wireless communication link; and a second transceiver located on the vehicle and coupled to at least one of the plurality of vehicle subsystems, the second transceiver being configured to receive the command from the first transceiver, wherein at least one of the vehicle subsystems is configured to execute a function in response to the command received by the directional controller.

15. The vehicle according to claim 14, wherein the wireless communication network operates in a frequency range between 900 MHz to 960 MHz.

16. The vehicle according to claim 14, wherein the plurality of vehicle subsystems comprises the following: a hydraulic system, a work light system, a proximity sensor system, an engine control system, a transmission control system, a braking system, and a central tire inflation system.

17. The vehicle according to claim 14, wherein the first transceiver is further configured to provide transmission of the vehicle data to a remote monitoring system over the wireless communication link.

18. The vehicle according to claim 14, wherein the first transceiver is configured to receive an inquiry relating to the vehicle data from a remote transceiver, the remote transceiver being coupled to a remote monitoring system, the remote monitoring system being configured to facilitate analysis of the vehicle data.

19. The vehicle according to claim 14, wherein the control system is configured to include a unique internet protocol (IP) address.

* * * * *